US006721525B2

(12) United States Patent
Wang et al.

(10) Patent No.: US 6,721,525 B2
(45) **Date of Patent: *Apr. 13, 2004**

(54) CARTRIDGE WITH A REPLACEABLE TONER CONTAINER FOR A LASER PRINTING IMAGING APPARATUS

(75) Inventors: Jui-Chi Wang, Taichung (TW); Yung-Nan Hsu, Taichung (TW); Ya-Li Huang, Taiching (TW); Kuan-Tung Li, Yunlin (TW); Shu-Hui Wang, Taichung (TW); Xiao-Hui Wang, Taichung (TW); Ting-Hsuan Ko, Taichung (TW); Ren-Hao Liu, Taichung (TW); Hui-Wen Hsieh, Taichung (TW); Chung Yu Chen, Taichung (TW)

(73) Assignee: General Plastics Industrial Co., Ltd. (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/272,897

(22) Filed: Oct. 17, 2002

(65) Prior Publication Data

US 2003/0091371 A1 May 15, 2003

(30) Foreign Application Priority Data

Nov. 12, 2001 (TW) ..... 90219592 U

(51) Int. Cl.[7] ..... G03G 15/08
(52) U.S. Cl. ..... 399/258; 399/262
(58) Field of Search ..... 399/105, 106, 399/109, 111, 112, 113, 258, 259, 260, 262; 222/DIG. 1; D18/43

(56) References Cited

U.S. PATENT DOCUMENTS

| | | | | |
|---|---|---|---|---|
| 4,456,154 A | | 6/1984 | Herriman | |
| 4,615,364 A | | 10/1986 | Kawata | |
| 4,615,608 A | | 10/1986 | Mizutani | |
| 4,942,432 A | | 7/1990 | Mort et al. | |
| 5,018,560 A | | 5/1991 | Tsukamoto | |
| 5,111,976 A | | 5/1992 | Ban | |
| 5,142,335 A | | 8/1992 | Sakata et al. | |
| 5,229,824 A | * | 7/1993 | Tsusaka et al. | 399/262 |
| 5,268,722 A | | 12/1993 | Ikkatai et al. | |
| 5,294,963 A | | 3/1994 | Nakano et al. | |
| 5,412,364 A | | 5/1995 | Iguchi et al. | |
| 5,475,469 A | | 12/1995 | Okada et al. | |
| 5,513,679 A | | 5/1996 | Yamada | |
| 5,520,229 A | | 5/1996 | Yamada | |
| 5,594,535 A | | 1/1997 | Beaufort et al. | |
| 5,621,507 A | | 4/1997 | Nishimura et al. | |

(List continued on next page.)

FOREIGN PATENT DOCUMENTS

| | | | | |
|---|---|---|---|---|
| DE | 20210097 U1 | * | 9/2002 | G03G/15/08 |
| JP | 59-16975 | | 2/1984 | |
| JP | 60 095464 | | 5/1985 | |
| JP | 07271165 A | * | 10/1995 | G03G/15/08 |
| JP | 08179611 A | | 7/1996 | |
| JP | 09120206 A | | 5/1997 | |
| JP | 2002-338778 A | | 12/2000 | |

*Primary Examiner*—Arthur T. Grimley
*Assistant Examiner*—Ryan Gleitz
(74) *Attorney, Agent, or Firm*—Morris, Manning & Martin; Tim Tingkang Xia, Esq.

(57) ABSTRACT

A toner supplying container detachably mountable to an image forming apparatus. In one embodiment, the toner supplying container includes a first container for receiving toner and a second container for accommodating toner and providing toner to the first container. The second container is releasably mounted to the first container at a predetermined position such that the first container and second container communicate to each other. The second container is replaceable when the toner accommodated in the second container is used up by a third container that is substantially identical to the second container but has toner therein.

37 Claims, 9 Drawing Sheets

U.S. PATENT DOCUMENTS

| | | | | |
|---|---|---|---|---|
| 5,946,520 | A | | 8/1999 | Hooper et al. |
| 6,009,289 | A | | 12/1999 | Sekine et al. |
| 6,014,536 | A | | 1/2000 | Ban et al. |
| 6,029,031 | A | | 2/2000 | Yokomori et al. |
| 6,115,571 | A | | 9/2000 | Kobayashi |
| 6,169,865 | B1 | | 1/2001 | Miyabe et al. |
| 6,267,263 | B1 | | 7/2001 | Emoff et al. |
| 6,269,234 | B1 | | 7/2001 | Kurz et al. |
| 6,289,193 | B1 | | 9/2001 | Ban et al. |
| 6,584,293 | B1 | * | 6/2003 | Wang et al. ..... 399/258 |
| 2001/0051062 | A1 | | 12/2001 | Yanigisawa et al. |
| 2002/0001485 | A1 | | 1/2002 | Ichikawa et al. |
| 2002/0025192 | A1 | | 2/2002 | Matsuda et al. |
| 2003/0039484 | A1 | * | 2/2003 | Naito et al. ..... 399/113 |

* cited by examiner

CARTRIDGE WITH A REPLACEABLE TONER CONTAINER FOR A LASER PRINTING IMAGING APPARATUS

BACKGROUND OF THE INVENTION

1. Field of the Invention

The present invention relates to a toner supply container for replenishing toner into an image forming apparatus such as an electrophotographic copying machine or a printer, and more particularly, to a toner supply container for replenishing toner into an image forming apparatus, that has a first container for receiving toner and a second container for accommodating toner and providing toner to the first container, where the second container is replaceable by a third container that is substantially identical to the second container.

2. Background

Heretofore, toner in the form of fine particles is used as a developer in the image forming apparatus such as an electrophotographic copying machine or a printer. When the developer in a main assembly of the image forming apparatus is used, the toner is supplied into the image forming apparatus using a toner supply container.

When the toner is used up, a new toner supply container with a supply of the toner is provided to replace the toner supply container, which then is discarded. However, conventional toner supply container currently available in the market includes installed therein at least a photosensitive member, a developing unit, a charger, and other parts and/or devices such as a cleaning device for processing the image. Thus, when a conventional toner supply container is discarded after the toner is used up, the conventional toner supply container as a whole is discarded with the parts and/or devices installed therein even if these parts and/or devices are often in good condition and can still be used. This not only results in a waste of materials and manufacturing time and cost, but also creates wastes that may endanger the environment.

Thus, there is a need to develop a new type of toner supplying container that overcomes the deficiencies of the conventional toner supplying container.

SUMMARY OF THE INVENTION

In one aspect, the present invention relates to a toner supplying container detachably mountable to an image forming apparatus. The toner supplying container in one embodiment has a first container for receiving toner and a second container for accommodating toner and providing toner to the first container.

The first container has a first end, an opposite second end, and a body defined between the first end and the opposite second end, wherein the body has a first surface, a second surface with a plurality of openings formed thereon for receiving a supply of toner into the body and an interior surface.

The second container has a first end, an opposite second end, and a body defined between the first end and the opposite second end, wherein the body has an interior surface defining a volume for accommodating toner, a first surface and a second surface with a plurality of openings formed thereon communicating with the volume and corresponding to the plurality of openings formed on the second surface of the first container for permitting a supply of the toner into the body of the first container.

Moreover, the toner supplying container has a releasable locking mechanism for releasably locking the first container with the second container at a predetermined position. The releasable locking mechanism has a supporting member projecting away from the second surface of the first container at the first end of the container. In one embodiment, the supporting member has a first side surface, a second side surface, an inner surface and an outer surface, wherein the first side surface has an opening partially defined by a first surface portion, a second surface portion and an edge portion connecting the first surface portion and the second surface portion.

A locking projection is provided at the first surface of the second container for engaging with the supporting member of the first container. In one embodiment, the locking projection has an engagement portion adapted to be received in the opening of the first side surface of the supporting member and engage with the edge portion of the supporting member when the second container is shifted to be mounted on the first container at the predetermined position.

Additionally, at least one guiding member is provided on the second surface of the first container, wherein in one embodiment the guiding member has a groove and a length. At least one projection is provided on the second surface of the second container complimentary to the guiding member on the second surface of the first container so that when the second container is shifted to be mounted on the first container at the predetermined position, the projection is received in the groove of the guiding member so as to be engaged by the guiding member. Moreover, when the second container is shifted away from the predetermined position, the engagement portion of the locking projection disengages the edge portion of the supporting member and the projection disengages the guiding member so as to allow the second container to be released from the first container.

The releasable locking mechanism may further include additional guiding members and additional projections. Each guiding member is provided on the second surface of the first container, having a groove and a length. Each projection is provided on the second surface of the second container complimentary to one of the additional guiding members on the second surface of the first container. When the second container is shifted to be mounted on the first container at the predetermined position, each additional projection is received in the groove of a corresponding additional guiding member so as to be engaged by the additional guiding member. Moreover, each pair of neighboring projections defines a recess therebetween to allow each projection is slidably received into the groove of a corresponding guiding member.

The releasable locking mechanism may further include a matching guiding member and a corresponding matching recess for preventing misengagement of the first container and the second container. In one embodiment, the matching guiding member is provided on the second surface of the first container, having a groove and a length that is different from the length of each guiding member, and the matching recess is provided on the second surface of the second container complimentarily to the matching guiding member on the second surface of the first container, wherein the matching recess is characterized by a width that is substantially same to the length of the matching guiding member to allow the matching guiding member to be received in the matching recess before a projection is received in the groove of the matching guiding member, when the second container is shifted to be mounted on the first container at the predetermined position, so as to be engaged by the matching guiding member.

The first container further includes a first seal member provided on the second surface for preventing toner from spilling. The first seal member can take various shapes, and be made from various materials. In one embodiment, the first seal member comprises a foam member that has a plurality of openings corresponding to the plurality of openings formed on the second surface of the first container to allow the supply of toner to be received into the body of the first container. The first container may further comprise a second seal member for covering the plurality of openings formed on the second surface of the first container. The first and second seal members can be made from same or different materials.

The second container may further include a first seal member provided on the second surface for preventing toner from spilling. The first seal member can take various shapes, and be made from various materials. In one embodiment, the first seal member comprises a foam member that has a plurality of openings corresponding to the plurality of openings formed on the second surface of the second container to allow the supply of toner into the body of the first container. The second container may further comprise a second seal member for covering the plurality of openings formed on the second surface of the second container. The first and second seal members can be made from same or different materials.

In yet another embodiment, the first container further has a sliding opening formed on the second surface of the first container between the supporting member and one of the plurality of openings that is located nearest to the supporting member, a first sliding projection formed on the interior surface at a first side of the plurality of openings, where the first sliding projection defines a sliding groove therein, a second sliding projection formed on the interior surface at a second, opposite side of the plurality of openings, where the second sliding projection defines a sliding groove therein, and a slidable cover having a first end, a second end, a plurality of openings formed therebetween the first end and the second end corresponding to the plurality of the openings formed on the second surface of the first container, and a handle formed proximate to the first end. The first sliding projection and the second sliding projection are formed such that the sliding groove of the first sliding projection and the sliding groove of the second sliding projection are adapted to receive the slidable cover therein, wherein the handle is positioned within the sliding opening, extending away from the second surface of the first container, and movable between a first predetermined position and a second predetermined position such that when the handle is positioned at the first predetermined position, the slidable cover closes the plurality of openings formed on the second surface of the first container, and when the handle is moved from the first predetermined position to the second predetermined position, the movement of the handle causes the slidable cover to shift in a direction to open the plurality of openings formed on the second surface of the first container.

The first container further comprises a seal member provided between the interior surface of and the slidable cover for preventing toner from spilling. In one embodiment, the seal member comprises a foam member having a plurality of openings corresponding to the plurality of openings formed on the second surface of the second container to allow the supply of toner into the body of the first container.

The second container may further have an end opening formed on the second surface of the second container, wherein the end opening is proximate to the first end of the second container and adapted to be engagable with the handle, a first guiding projection formed on the second surface at a first side of the plurality of openings, where the first guiding projection defines a guiding groove therein, a second guiding projection formed on the second surface at a second, opposite side of the plurality of openings, where the second guiding projection defines a guiding groove therein, and a slidable cover having a first end, a second end, an exterior surface, an opposite interior surface, a plurality of openings formed therebetween the first end and the second end corresponding to the plurality of the openings formed on the second surface of the second container. The first guiding projection and the second guiding projection are formed such that the guiding groove of the first guiding projection and the guiding groove of the second guiding projection are adapted to receive the slidable cover therein with the interior surface of the slidable cover facing the second surface of the second container to allow the slidable cover to be shifted to open or close the plurality of openings formed on the second surface of the second container.

When the second container is to be mounted on the first container at the predetermined position, the handle is positioned in the first predetermined position and received in the end opening so as to engage with the second surface of the second container, wherein when the second container is shifted to be mounted on the first container at the predetermined position, the shifting movement of the second container causes the handle to move by the engagement between the handle and the end opening from the first predetermined position to the second predetermined position, and the movement of the handle causes the slidable cover to shift in a direction to be able to open the plurality of openings formed on the second surface of the first container.

The second container may further include a first seal member provided between the second surface of the second container and the interior surface of the slidable cover for preventing toner from spilling. The first seal member in one embodiment comprises a foam member is formed on the interior surface of the slidable cover and has a plurality of openings corresponding to the plurality of openings formed on the slidable cover.

The second container may also include a second seal member provided between the second surface of the second container and the interior surface of the slidable cover for covering the plurality of openings formed on the second surface of the second container. The second seal member in one embodiment comprises a grip portion and being engaged with the first seal member or the foam member formed on the interior surface of the slidable cover.

When the grip portion is pulled in a direction away from the opening, the motion of the grip portion causes the second seal member to shift in a direction substantially parallel to the motion direction of the grip portion thereby to open at least some of the plurality of openings formed on the second surface of the second container, and the shifting motion of the second seal member causes the slidable cover to move with the second seal member to open at least some of the plurality of openings formed on the second surface of the second container by allowing at least one of the plurality of opening formed on the slidable cover to communicate with at least one of the plurality of openings formed on the second surface of the second container.

The second container further comprises a plurality of regulating projections formed on the exterior surface of the slidable cover, each regulating projection being formed around the periphery of a corresponding one of the plurality of openings formed on the slidable cover and projecting away from the exterior surface of the slidable cover.

In another aspect, the invention relates to a toner supplying container detachably mountable to an image forming apparatus. In one embodiment, the toner supplying container has a first container for receiving toner and a second container for accommodating toner and mountable to the first container at a predetermined position for providing toner to the first container.

The first container has a first end, an opposite second end, and a body defined between the first end and the opposite second end, wherein the body has an interior surface defining a volume, a first surface, and a second surface with a plurality of openings formed thereon communicating with the volume for receiving a supply of toner into the volume. The first container additionally has a supporting member projecting away from the second surface of the first container at the first end of the container. The supporting member has a first side surface, a second side surface, an inner surface and an outer surface, wherein the first side surface has an opening partially defined by a first surface portion, a second surface portion and an edge portion connecting the first surface portion and the second surface portion. The first container further has at least one guiding member provided on the second surface of the first container, the guiding member having a groove and a length.

The second container has a first end, an opposite second end, and a body defined between the first end and the opposite second end, wherein the body has an interior surface defining a volume for accommodating toner, a first surface and a second surface with a plurality of openings formed thereon communicating with the volume and corresponding to the plurality of openings formed on the second surface of the first container for permitting a supply of the toner into the body of the first container, a locking projection provided at the first surface of the second container for engaging with the supporting member of the first container, wherein the locking projection has an engagement portion adapted to be received in the opening of the first side surface of the supporting member of the first container and engage with the edge portion of the supporting member of the first container when the second container is shifted to be mounted on the first container at the predetermined position, and at least one projection provided on the second surface of the second container complimentary to the guiding member on the second surface of the first container. When the second container is shifted to be mounted on the first container at the predetermined position, the projection is received in the groove of the guiding member so as to be engaged by the guiding member, wherein when the second container is shifted away from the predetermined position, the engagement portion of the locking projection disengages the edge portion of the supporting member and the projection disengages the guiding member so as to allow the second container to be released from the first container.

In a further aspect, the invention relates to a toner supplying container detachably mountable to an image forming apparatus. The toner supplying container comprises a first container for receiving toner and a second container for accommodating toner and mountable to the first container at a predetermined position for providing toner to the first container. The first container has a first end, an opposite second end, and a body defined between the first end and the opposite second end, wherein the body has an interior surface defining a volume, a first surface, and a second surface with a plurality of openings formed thereon communicating with the volume for receiving a supply of toner into the volume, a supporting member projecting away from the second surface of the first container at the first end of the container, wherein the supporting member has a first side surface, a second side surface, an inner surface and an outer surface, wherein the first side surface has an opening partially defined by a first surface portion, a second surface portion and an edge portion connecting the first surface portion and the second surface portion, and a plurality of guiding members provided on the second surface of the first container, each guiding member having a groove and a length.

The second container has a first end, an opposite second end, and a body defined between the first end and the opposite second end, wherein the body has an interior surface defining a volume for accommodating toner, a first surface and a second surface with a plurality of openings formed thereon communicating with the volume and corresponding to the plurality of openings formed on the second surface of the first container for permitting a supply of the toner into the body of the first container, a locking projection provided at the first surface of the second container for engaging with the supporting member of the first container, wherein the locking projection has an engagement portion adapted to be received in the opening of the first side surface of the supporting member of the first container and engage with the edge portion of the supporting member of the first container when the second container is shifted to be mounted on the first container at the predetermined position, and a plurality of projections provided on the second surface of the second container complimentary to the plurality of guiding members on the second surface of the first container. When the second container is shifted to be mounted on the first container at the predetermined position, each projection is received in the groove of a corresponding guiding member so as to be engaged by the corresponding guiding member, and wherein each pair of neighboring projections defines a recess therebetween to allow each projection is slidably received into the groove of a corresponding guiding member, and wherein when the second container is shifted away from the predetermined position, the engagement portion of the locking projection disengages the edge portion of the supporting member and the projection disengages the guiding member so as to allow the second container to be released from the first container.

In a further aspect, the invention relates to a method of supplying toner to a toner supplying container detachably mounted to an image forming apparatus, wherein the toner supplying container has a first container for receiving toner and a second container for accommodating toner and mountable to the first container at a predetermined position for providing toner to the first container. The first container has a first end, an opposite second end, and a body defined between the first end and the opposite second end, wherein the body has an interior surface defining a volume, a first surface, and a second surface with a plurality of openings formed thereon communicating with the volume for receiving a supply of toner into the volume, and contains a photosensitive member, a charger and a developing unit in the volume for developing an image. The second container has a first end, an opposite second end, and a body defined between the first end and the opposite second end, wherein the body has an interior surface defining a volume for accommodating toner, a first surface and a second surface with a plurality of openings formed thereon communicating with the volume and corresponding to the plurality of openings formed on the second surface of the first container for permitting a supply of the toner into the body of the first container. In one embodiment, the method includes the steps of disengaging the second container from the first container when the toner accommodated in the volume of the second container is substantially supplied to the body of the first container, and mounting a third container that is substantially identical to the second container but has toner therein on the first container at the predetermined position so as to provide a supply of the toner into the body of the first container.

These and other aspects will become apparent from the following description of the preferred embodiment taken in conjunction with the following drawings, although variations and modifications therein may be affected without departing from the spirit and scope of the novel concepts of the disclosure.

DETAILED DESCRIPTION OF THE FIGURES OF THE DRAWINGS

The accompanying drawings, which are incorporated in and constitute a part of this specification, illustrate various embodiments of the invention and together with the description, serve to explain the principals of the invention.

FIG. 1 is a perspective view of a toner supplying container 100 according to one embodiment of the invention, wherein a first container 1 and a second container 2 as shown are not engaged to each other.

Figure 8:
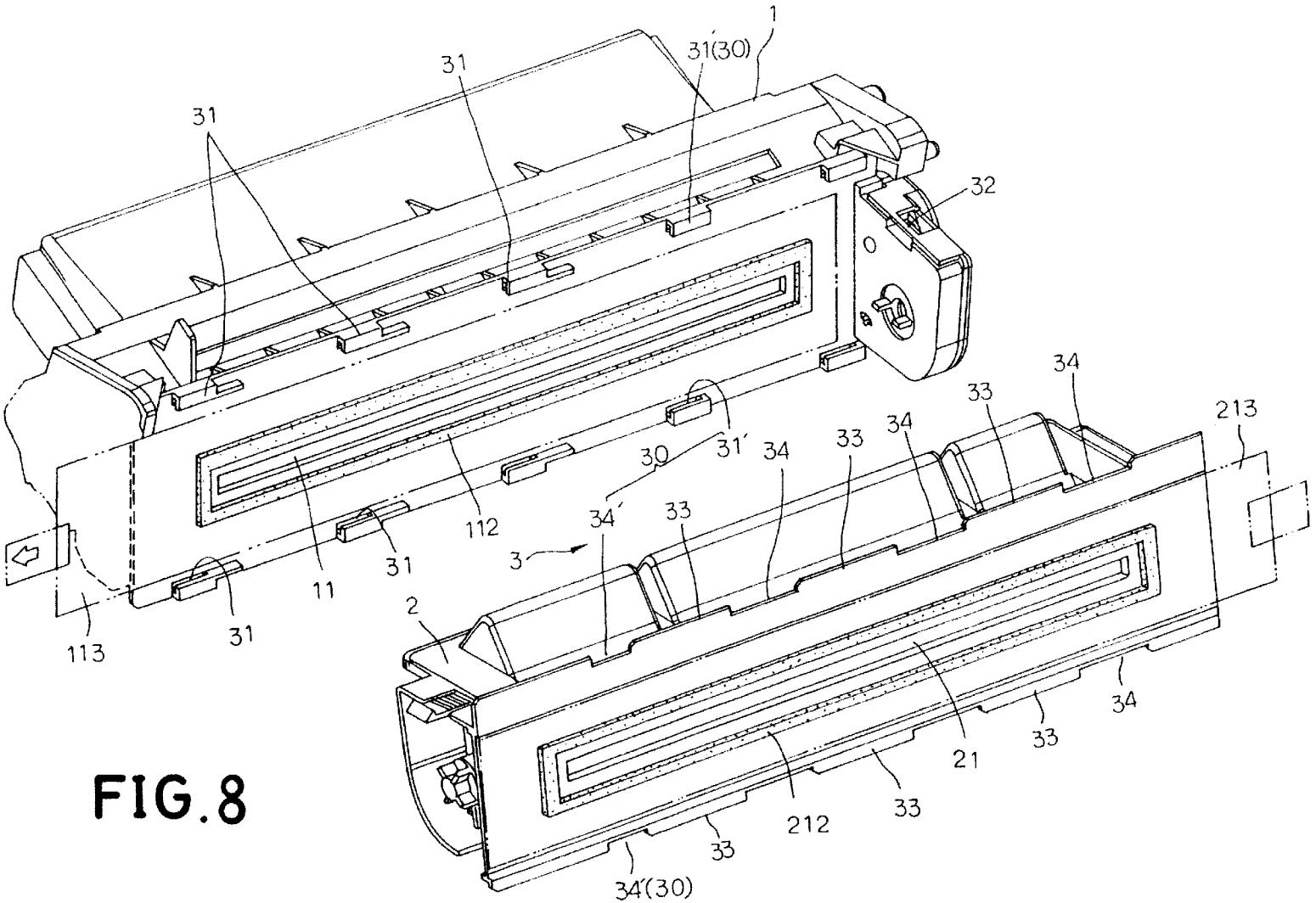

FIG. 8 is a perspective view of a toner supplying container 200 according to another embodiment of the invention, wherein a first container 1 and a second container 2 as shown are not engaged to each other.

Figure 9:
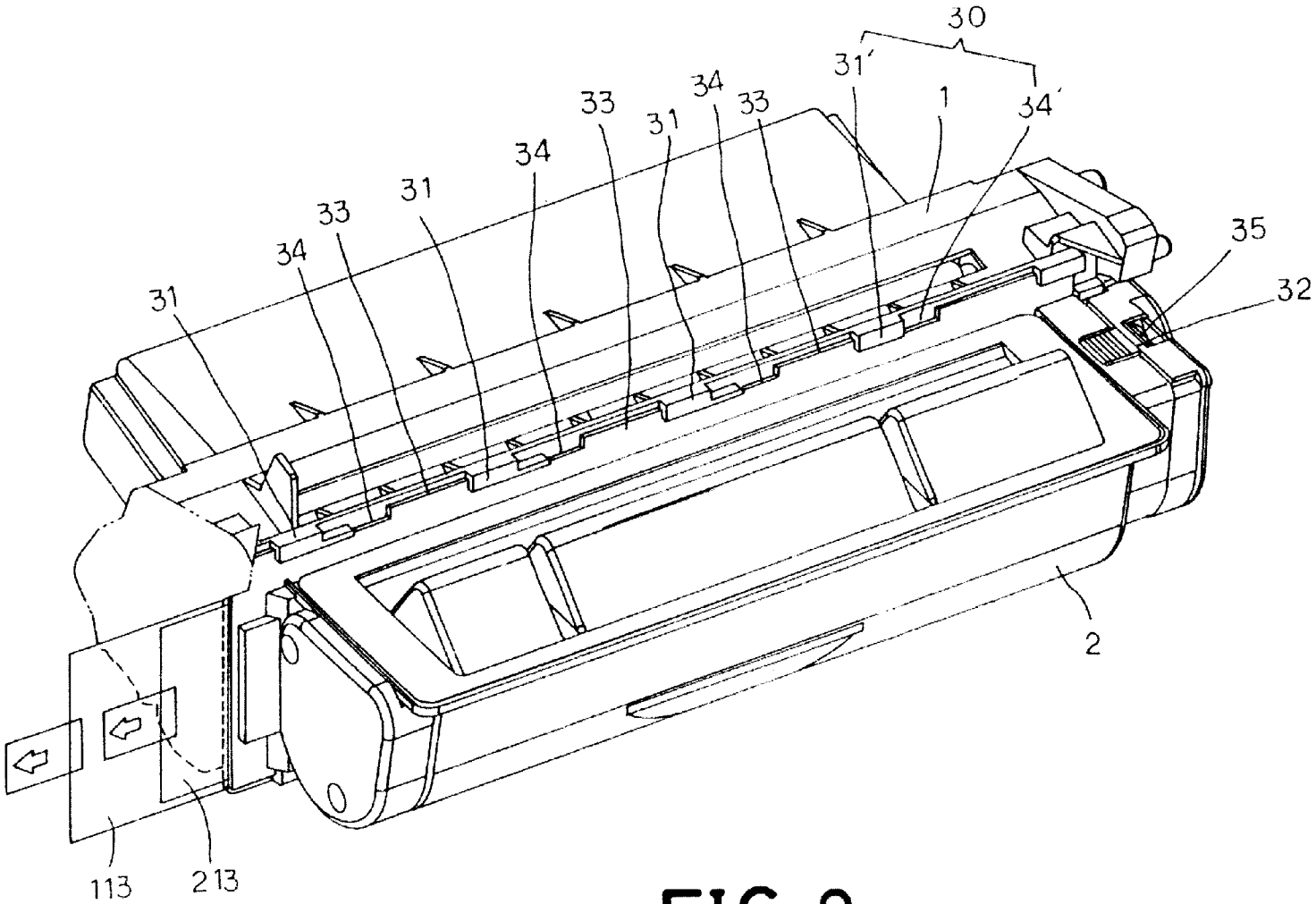

FIG. 9 is a perspective view of the container of FIG. 8, wherein the first container 1 and the second container 2 are engaged to each other.

DETAILED DESCRIPTION OF THE INVENTION

The present invention is more particularly described in the following examples that are intended to be illustrative only since numerous modifications and variations therein will be apparent to those skilled in the art. Various embodiments of the invention are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings. In accordance with the purposes of this invention, as embodied and broadly described herein, this invention, in one aspect, relates to a toner supplying container detachably mountable to an image forming apparatus.

Figure 1:
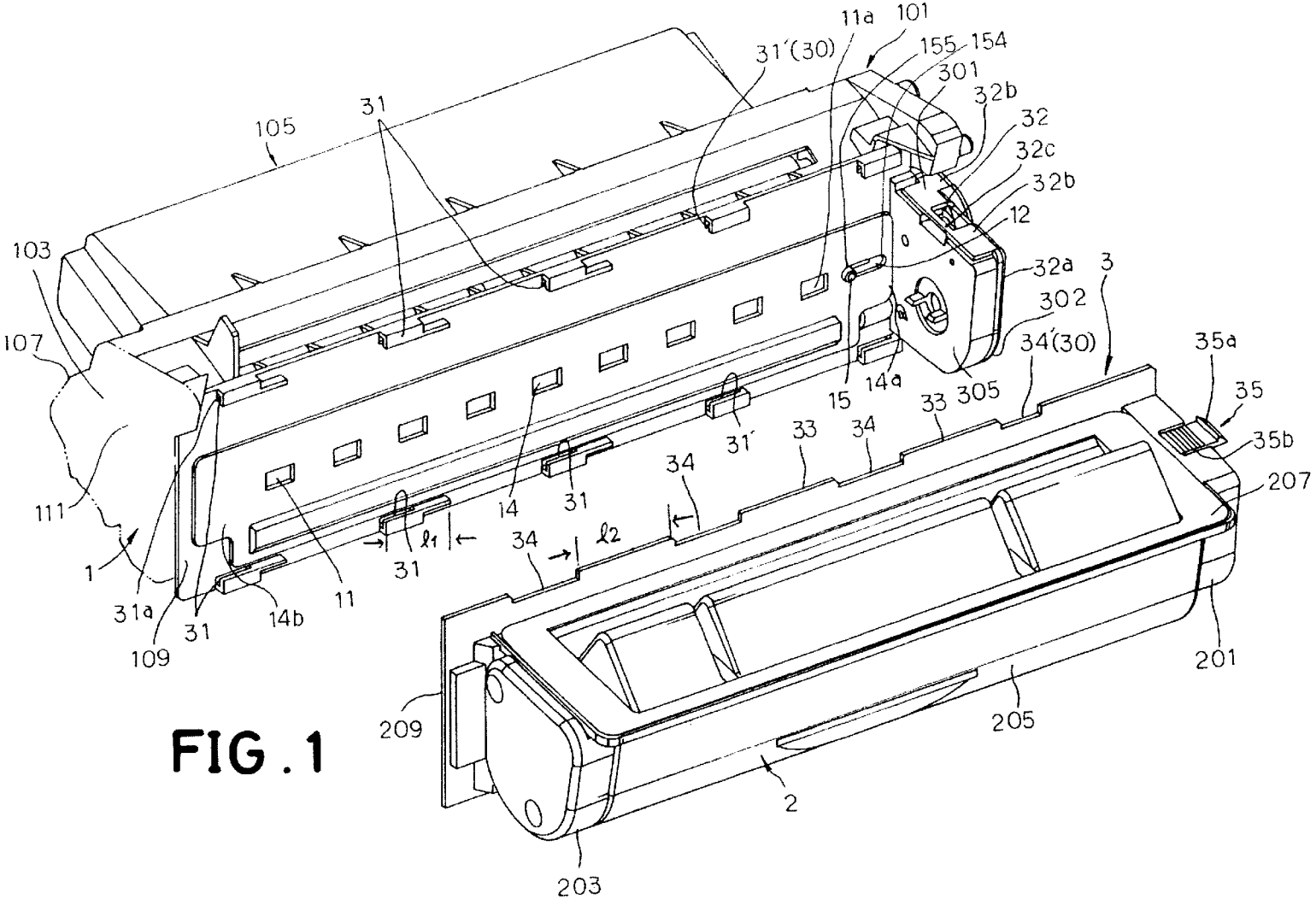
Figure 2:
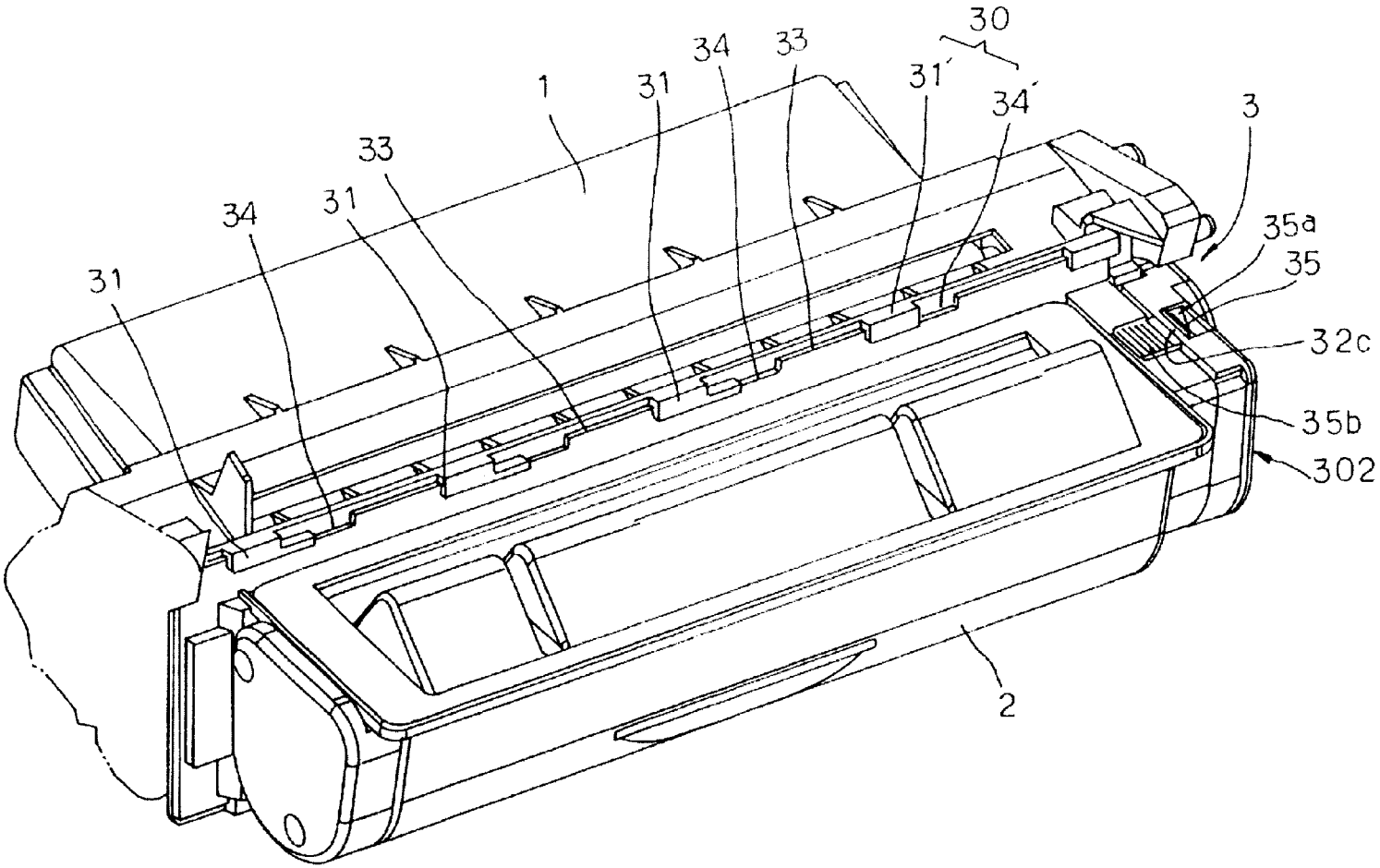
FIG. 2 is a perspective view of the container of FIG. 1, wherein the first container 1 and the second container 2 are engaged to each other.
Figure 3:
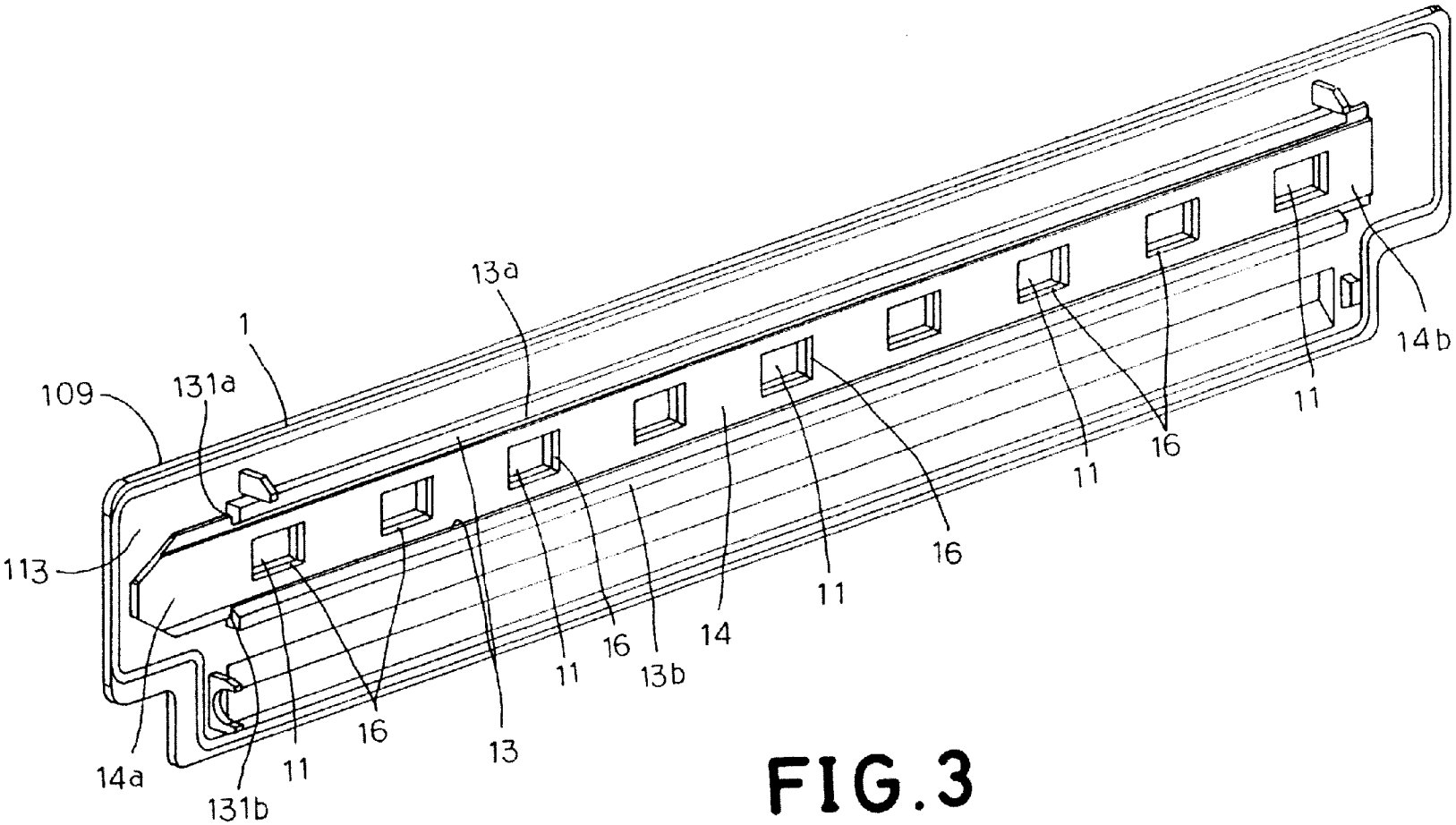
FIG. 3 is a back, perspective, and partial view of the container 1 of FIG. 1 wherein a slidable cover 14 is shown at an open position.

Referring in general to FIGS. 1–7, and in particular to FIG. 1 first, a toner supplying container 100 in one embodiment has a first container 1 for receiving toner. The first container 1 has a first end 101, an opposite second end 103, and a body 105 defined between the first end 101 and the opposite second end 103. As formed, the body 105 has a first surface 107 and a second surface 109 defining a volume 111 inside the body 105. The body 105 further has an interior surface 113 opposite the second surface 109 as a part of bounds of the volume 111, as best shown in FIG. 3. A plurality of openings 11 is formed thereon the second surface 109 for receiving a supply of toner into the body 105, more specifically, into the volume 111 of the body 105. The first container 1 may further have a photosensitive member, a developing unit, a charger, and other parts and/or devices such as a cleaning device for processing image installed therein, as shown in phantom lines in FIG. 7.

Figure 5:
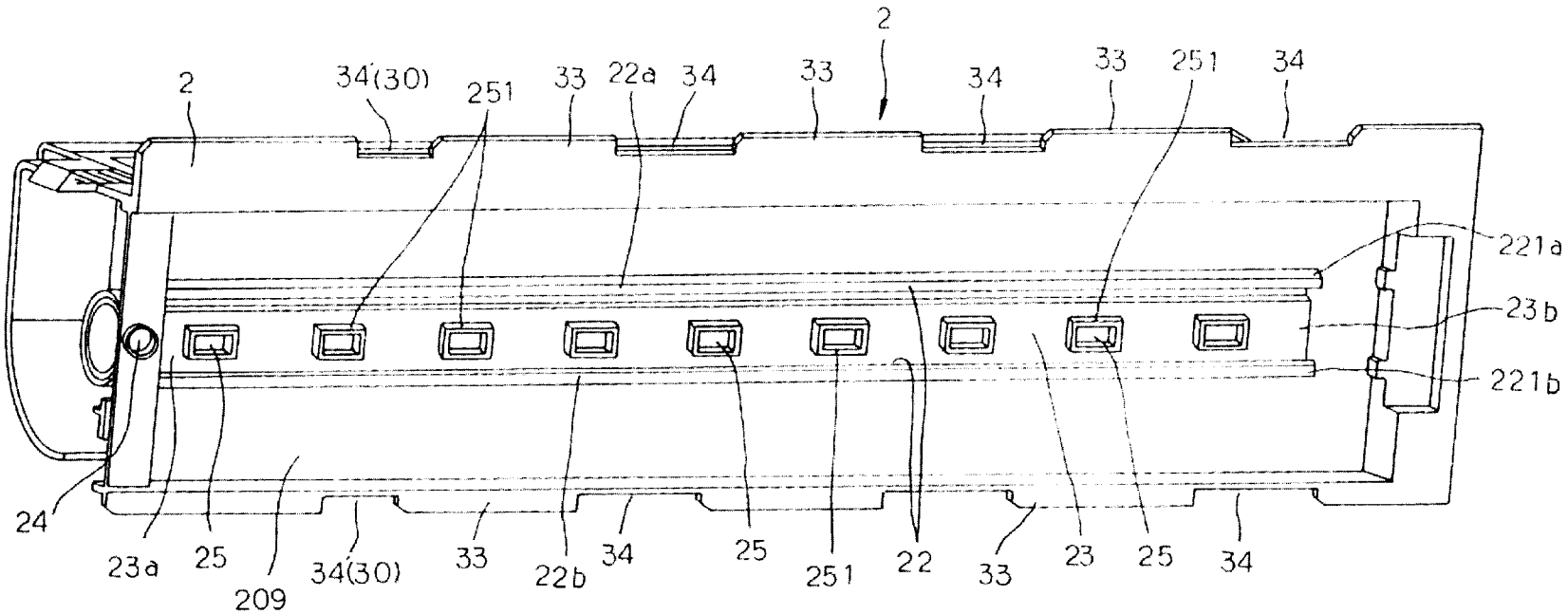
FIG. 5 is a partial perspective view of the container 2 of FIG. 1, wherein a slidable cover 23 is shown at an open position.
Figure 6:
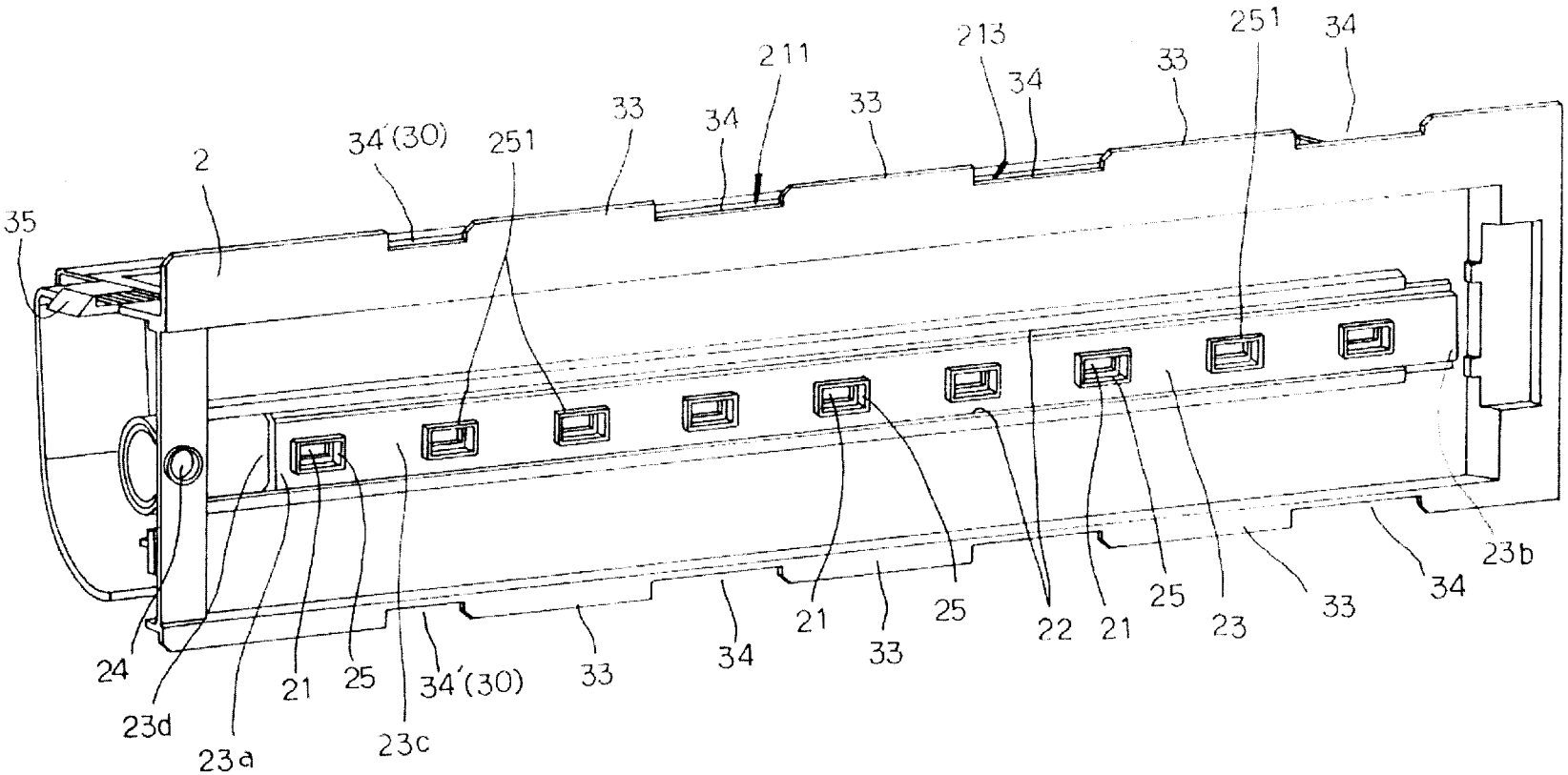
FIG. 6 is a partial perspective view of the container 2 of FIG. 1 as seen in FIG. 5 with the slidable cover 23 at a closed position.
Figure 7:
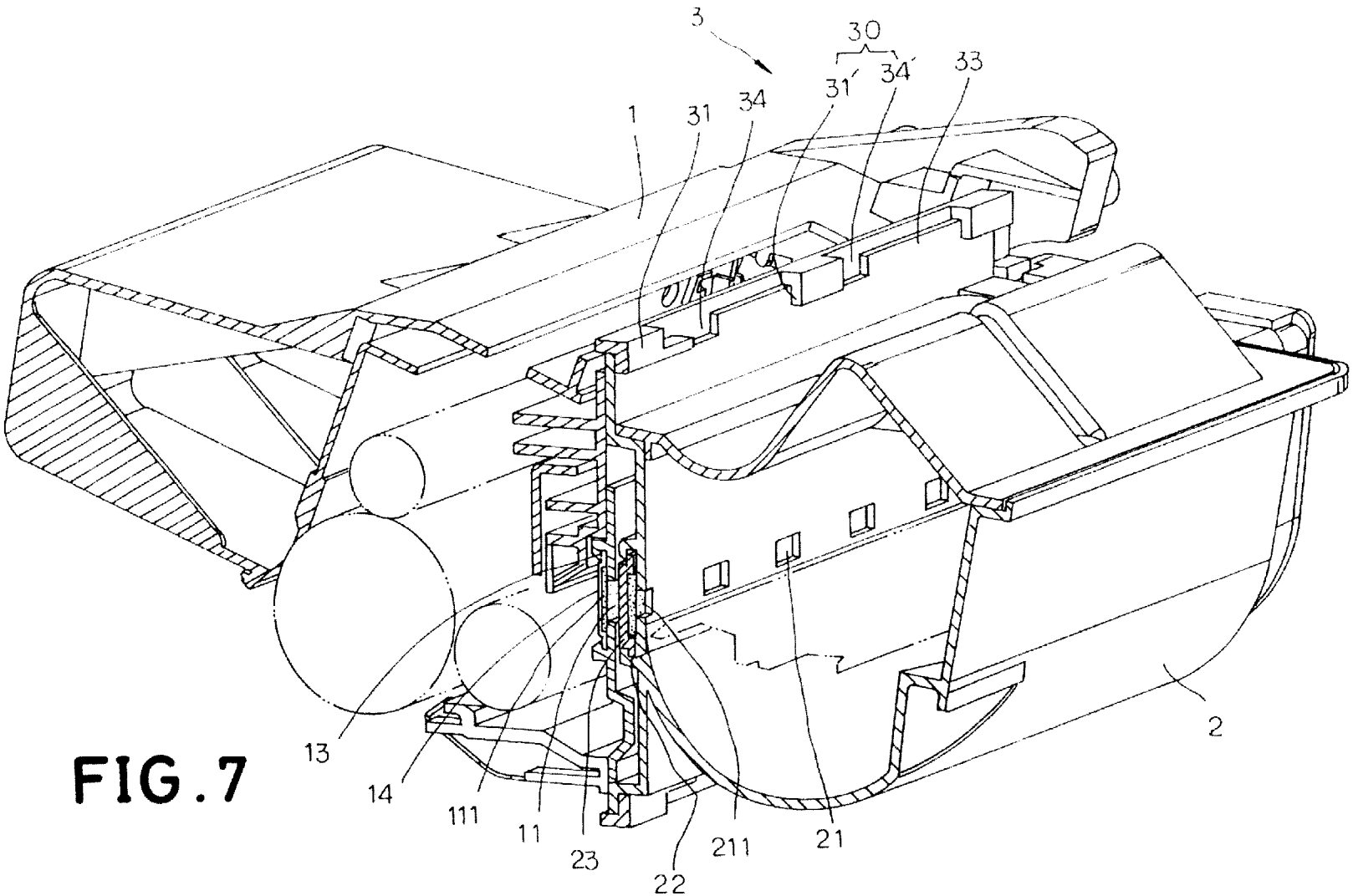
FIG. 7 is a partly enlarged sectional view of the toner supplying container of FIG. 1.

The toner supplying container 100 further has a second container 2 for accommodating toner and providing toner to the first container 1. Referring now to FIGS. 1, 5 and 6, the second container 2 has a first end 201, an opposite second end 203, and a body 205 defined between the first end 201 and the opposite second end 203. As formed, the body 205 has an interior surface 213 defining a volume 211 for accommodating toner, as best shown in FIG. 7. The body 205 has a first surface 207 and a second surface 209 with a plurality of openings 21 formed thereon. The plurality of openings 21 is formed and arranged to be communicating with the volume 211 and corresponding to the plurality of openings 11 formed on the second surface 109 of the first container 1 for permitting a supply of the toner from the volume 211 of the second container 2 into the volume 111 of the body 105 of the first container 1.

Moreover, the toner supplying container 100 has a releasable locking mechanism 3 for releasably locking the first container 1 with the second container 2 at a predetermined position. In one embodiment, as best shown in FIGS. 1 and 2, the releasable locking mechanism 3 has a supporting member 302 projecting away from the second surface 109 of the first container 1 at the first end 101 of the container 1. The supporting member 302 has a first side surface 301, a second side surface 303, an inner surface 305 and an outer surface 307. The first side surface 301 has an opening 32 partially defined by a first surface portion 32*a*, a second surface portion 32*b* and an edge portion 32*c* connecting the first surface portion 32*a* and the second surface portion 32*b*. A locking projection 35 is provided at the first surface 207 of the second container 2 for engaging with the supporting member 302 of the first container 1. The locking projection 35 has an engagement portion 35*a* adapted to be received in the opening 32 of the first side surface 301 of the supporting member 302 and engage with the edge portion 32*c* of the supporting member 302 when the second container 2 is shifted to be mounted on the first container 1 at a predetermined position, which is corresponding to an operative position. The engagement portion 35*a* can take various forms and can be made from different materials. In the embodiment as shown in FIG. 1, for example, the engagement portion 35*a* is a hook that is sized and shaped to engage with the edge portion 32*c* in the form of a bar that is correspondingly sized and shaped. Alternatively, the engagement portion 35*a* may contain a magnetic material to be engaged with the edge portion 32*c* if the edge portion 32*c* is partially made from a metallic material. Furthermore, the locking projection 35 can have an optional toothed surface 35*b,* as shown in FIGS. 1 and 2, to encourage engagement between the engagement portion 35*a* and the edge portion 32*c* by, for example, preventing the locking projection 35 from shifting when the engagement portion 35*a* engages with the edge portion 32*c* as shown in FIG. 2.

At least one guiding member 31 is provided on the second surface 109 of the first container 1. The guiding member 31 has a groove 31*a* and a length $l_1$, and at least one projection 33 is provided on the second surface 209 of the second container 2 complimentary in terms of, among other things, size such as $l_2$, shape and position to the guiding member 31 on the second surface 109 of the first container 1. In operation, when the second container 2 is shifted to be mounted on the first container 1 at the predetermined position as shown in FIG. 2, the projection 33 is received in the groove 31*a* of the guiding member 31 so as to be engaged by the guiding member 31 and the locking projection 35 of the container 2 engages the edge portion 32*c* of the container 1. Conversely, when the second container 2 is shifted away from the first container 1 at the predetermined position as shown in FIG. 2, the engagement portion 35*a* of the locking projection 35 disengages the edge portion 32*c* of the supporting member 302 and the projection 33 disengages the guiding member 31 so as to allow the second container 2 to be released from the first container 1. Several ways are available to release the second container 2 from the first container 1. In one embodiment, for example, the second container 2 is first shifted along a direction $O_1$ so as to cause the engagement portion 34*a* to move away from and therefore to disengage the edge portion 32*c*. Subsequently, the second container 2 is shifted along a direction $O_2$, which is the opposite direction of direction $O_1$, so as to fully release the second container 2 from the first container 1. A small force may be applied to the second container 2 along a direction $U_2$ to avoid accidental re-engagement the locking projection 34 with the edge portion 32*c* and thus facilitate the releasing process.

The releasable locking mechanism 3 may have additional guiding members 31 provided on the second surface 109 of the first container 1. Each guiding member has a groove 31*a* and a length. Correspondingly, the releasable locking mechanism 3 has additional projections 33 provided on the second surface 209 of the second container 2 complimentary to the additional guiding members 31 on the second surface 109 of the first container 1 such that when the second container 2 is shifted to be mounted on the first container 1 at the predetermined position, each additional projection 33 is received in the groove 31*a* of a corresponding additional guiding member 31 so as to be engaged by the additional guiding member 31. Each pair of neighboring projections 33 defines a recess 34 therebetween to allow each projection 33 is slidably received into the groove 31*a* of a corresponding guiding member 31.

Moreover, as best shown in FIGS. 1 and 2, the releasable locking mechanism 3 may include an optional matching guiding member 31' provided on the second surface 109 of the first container 1 for preventing misengagement of the first container 1 and the second container 2. The matching guiding member 31' has a groove 31*a'* and a length $l_3$ that is different from the length $l_1$ of each of the guiding members 31. Correspondingly, the releasable locking mechanism 3 has a matching recess 34' provided on the second surface 209 of the second container 2 complimentarily to the matching guiding member 31' on the second surface 109 of the first container 1, wherein the matching recess 34' is characterized by a width $l_4$ that is substantially same to the length $l_3$ of the matching guiding member 31' to allow the matching guiding member 31' to be received in the matching recess 34' before a projection 33 is received in the groove 31*a* of the matching guiding member 31, when the second container 2 is shifted to be mounted on the first container 1 at the predetermined position, so as to be engaged by the matching guiding member 31'. In other words, the pair of matching guiding member 31' provided on the second surface 109 of the first container 1 and corresponding matching recess 34' provided on the second surface 209 of the second container 2 effectively forms an optional misengagement preventing mechanism 30 that allows the first container 1 and the second container 2 to be engaged at a desired position only when the matching guiding member 31' and the matching recess 34' are properly engaged to each other. For example, any of the guiding members 31 cannot be received in the matching recess 34 because, for the embodiment as shown in FIG. 1, the length $l_1$ of each guiding member 31 is longer than the width $l_4$ of the matching recess 34'. Therefore, introducing a guiding member 31 to the matching recess 34 would create a mismatch that effectively prevents the first container 1 and the second container 2 from being misengaged together.

The first container 1 may further have a foam member 312 provided on the second surface 109 for preventing toner from spilling as shown in FIG. 7. In one embodiment, the foam member 312 has a plurality of openings corresponding to the plurality of openings 11 formed on the second surface 109 of the first container 1 to allow the supply of toner to be received into the body 105 of the first container 1. The first container 1 may further have a sealing member (not shown) for covering the plurality of openings 11 formed on the second surface 109 of the first container 1.

The second container 2 additionally may have a foam member 412 provided on the second surface 209 for preventing toner from spilling. In one embodiment, the foam member 412 has a plurality of openings corresponding to the plurality of openings 21 formed on the second surface 209 of the second container 2 to allow the supply of toner into the body 105 of the first container 1 from the body 205 (i.e., from the volume 211) of the second container 2. The second container 2 may further have a sealing member (not shown) for covering the plurality of openings 21 formed on the second surface 209 of the second container 2.

Figure 4:
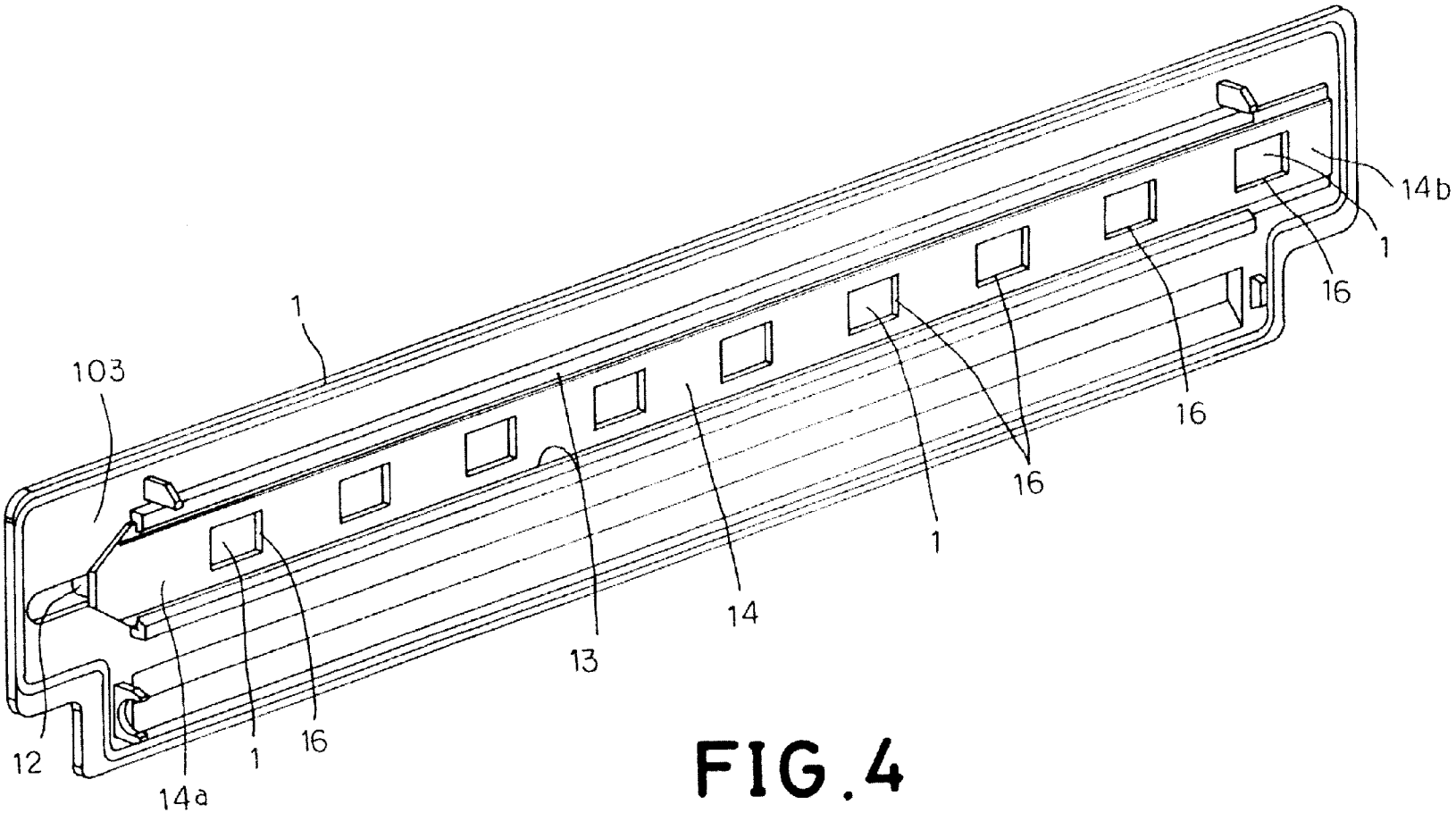
FIG. 4 is a back, perspective, and partial view of the container 1 of FIG. 1 as seen in FIG. 3 the slidable cover 14 at a closed position.

Furthermore, as shown in FIGS. 1, 3 and 4, the first container 1 may have a sliding opening 12 formed on the second surface 109 of the first container 1 between the supporting member 302 and opening 11*a* that is one of the plurality of openings 11 and is located nearest to the supporting member 302. A first sliding projection 13*a* is formed on the interior surface 103 at a first side of the plurality of openings 11. The first sliding projection 13*a* defines a sliding groove 131*a* therein. Moreover, a second sliding projection 13*b* is formed on the interior surface 103 at a second, opposite side of the plurality of openings 11. The second sliding projection 13*b* defines a sliding groove 131*b* therein. Both the first sliding projection 13*a* and the a second sliding projection 13*b* form a sliding member 13. Furthermore, a slidable cover 14 has a first end 14*a,* a second end 14*b,* a plurality of openings 16 formed therebetween the first end 14*a* and the second end 14*b* corresponding to the plurality of the openings 11 formed on the second surface 109 of the first container 1, and a handle 15 formed proximate to the first end 14*a*. The first sliding projection 13*a* and the second sliding projection 13*b* are formed such that the sliding groove 131*a* of the first sliding projection 13*a* and the sliding groove 131*b* of the second sliding projection 13*b* are adapted to receive the slidable cover 14 therein, wherein the handle 15 is positioned within the sliding opening 12, extending away from the second surface 109 of the first container 1, and movable between a first predetermined position 154 that is the end of opening 12 proximate to the supporting member 302 and a second predetermined position 155 that is the other end of opening 12 distant from the supporting member 302. When the handle 15 is positioned at the first predetermined position 154, the slidable cover 14 closes the plurality of openings 11 formed on the second surface 109 of the first container 1, and when the handle 15 is moved from the first predetermined position 154 to the second predetermined position 155, the movement of the handle 15 causes the slidable cover 14 to shift in a direction to open the plurality of openings 11 formed on the second surface 109 of the first container 1.

Referring now to FIGS. 1, 5 and 6, the second container 2 may have an end opening 24 formed on the second surface 209 of the second container 2, wherein the end opening 24 is proximate to the first end 201 of the second container 2 and adapted to be engagable with the handle 15 associated with the first container 1. Moreover, a first guiding projection 22*a* is formed on the second surface 209 at a first side of the plurality of openings 21, the first guiding projection 22*a* defining a guiding groove 221*a* therein. Additionally, a second guiding projection 22*b* is formed on the second surface 203 at a second, opposite side of the plurality of openings 21, the second guiding projection 22*b* defining a guiding groove 221*b* therein. Both the first guiding projection 22*a* and the second guiding projection 22*b* form a guiding member 22. Furthermore, a slidable cover 23 has a first end 23*a*, a second end 23*b*, an exterior surface 23*c*, an opposite interior surface 23*d*, a plurality of openings 25 formed therebetween the first end 23*a* and the second end 23*b* corresponding to the plurality of the openings 21 formed on the second surface 209 of the second container 2, wherein the first guiding projection 22*a* and the second guiding projection 22*b* are formed such that the guiding groove 221*a* of the first guiding projection 22*a* and the guiding groove 221*b* of the second guiding projection 22*b* are adapted to receive the slidable cover 23 therein with the interior surface 23*d* of the slidable cover 23 facing the second surface 203 of the second container 2 to allow the slidable cover 23 to be shifted to open or close the plurality of openings 21 formed on the second surface 209 of the second container 2, as best shown in FIG. 6.

In operation, when the second container 2 is to be mounted on the first container 1 at the predetermined position, the handle 15 is positioned in the first predetermined position 154 and received in the end opening 24 so as to engage with the second surface 209 of the second container 2 thus when the second container 2 is shifted to be mounted on the first container 1 at the predetermined position, the shifting movement of the second container 2 causes the handle 15 to move by the engagement between the handle 15 and the end opening 24 from the first predetermined position 154 to the second predetermined position 155, and the movement of the handle 15 causes the slidable cover 14 to shift in a direction with the container 2 to be able to open the plurality of openings 11 formed on the second surface 109 of the first container 1.

The foam member 412 in this embodiment is provided between the second surface 209 of the second container 2 and the interior surface 23*d* of the slidable cover 23 for preventing toner from spilling. The foam member 412 for example can be formed on the interior surface 23*d* of the slidable cover 23 and has a plurality of openings corresponding to the plurality of openings 25 formed on the slidable cover 23.

Optionally, as discussed above, the second container may have a sealing member (not shown), such as a sealing member 413 discussed below, provided between the second surface 209 of the second container 2 and the interior surface 23*d* of the slidable cover 23 for covering the plurality of openings 21 formed on the second surface 209 of the second container 2. The sealing member may have a grip portion and be engaged with the foam member 412 formed on the interior surface 23*d* of the slidable cover 23. Thus, when the grip portion of this sealing member is pulled in a direction away from the opening 24, the motion of the grip portion causes the sealing member to shift in a direction substantially parallel to the motion direction of the grip portion thereby to open at least some of the plurality of openings 21 formed on the second surface 209 of the second container 2, and the shifting motion of the sealing member causes the slidable cover 23 to move with the sealing member to open at least some of the plurality of openings 21 formed on the second surface of the second container by allowing at least one of the plurality of opening 25 formed on the slidable cover 23 to communicate with at least one of the plurality of openings 21 formed on the second surface 209 of the second container 2.

The second container 2 may further have a plurality of regulating projections 251 formed on the exterior surface 23*c* of the slidable cover 23. Each regulating projection 251 is formed around the periphery of a corresponding one of the plurality of openings 25 formed on the slidable cover 23 and projecting away from the exterior 23*c* surface of the slidable cover 23. In one embodiment, these regulating projections 251 are received in corresponding openings formed on foam member 312 provided on the second surface 109 of the container 1 for further preventing toner from the spilling.

In some embodiments described in the forgoing, the exemplary toner supplying container uses the slidable cover 14 of the first container 1 and the slidable cover 23 of the second container 2, respectively, to open or close communication between the first container 1 and the second container 2 with respect to the supply of the toner. An alternative embodiment is shown in FIGS. 8 and 9.

As shown in FIGS. 8 and 9, a toner supplying container 200 detachably mountable to an image forming apparatus (not shown) has a first container 1 for receiving toner and a second container 2 for accommodating toner and providing toner to the first container 1. The first container 1 has a structure similar to what is described, in particular, the first container 1 has a first end, an opposite end, and a body defined between the first end and the opposite second end, wherein the body has a first surface, a second surface with an opening 11 formed thereon for receiving a supply of toner into the body.

The second container 2 has a structure similar to what is described, in particular, the second container 2 has a first end, an opposite second end, and a body defined between the first end and the opposite second end, wherein the body has an interior surface defining a volume for accommodating toner, a first surface and a second surface with an opening 21 formed thereon communicating with the volume and adapted for communicating with the opening 11 formed on the second surface of the first container for permitting a supply of the toner into the body of the first container.

A releasable locking mechanism 3 is provided for releasably locking the first container 1 with the second container 2 at a predetermined position as best shown in FIG. 9. As described above, among other things, the releasable locking mechanism 3 the releasable locking mechanism 3 has a supporting member 302 projecting away from the second surface 109 of the first container 1 at one end of the container 1. The supporting member 302 has an opening 32. A locking projection 35 is provided at the first surface 207 of the second container 2 for engaging with the supporting member 302 of the first container 1 when the second container 2 is shifted to be mounted on the first container 1 at a predetermined position, which is corresponding to an operative position.

The first container 1 has a foam member 112 provided on the second surface of the first container 1 for preventing toner from spilling. As best shown in FIG. 8, the foam member 112 has an opening 311 corresponding to the opening 11 formed on the second surface of the first container 1 to allow the supply of toner to be received into the body of the first container 1.

The first container 1 further has a sealing member 313 for covering the opening 311 of the foam member 112 and thus the opening 11 formed on the second surface 109 of the first container 1. The sealing member 313 may have an optional grip portion 114 for a user to pull the sealing member 313 so as to uncover the opening 311 and opening 11. The grip portion 314 may have a mark thereon to indicate a pulling direction for a user.

The second container 2 has a foam member 212 provided on the second surface 209 of the second container 2 for preventing toner from spilling. As best shown in FIG. 8, the foam member 212 has an opening 221 corresponding to the opening 21 formed on the second surface 209 of the second container 2 to allow the supply of toner to pass into the body of the first container 1.

The second container 2 further has a sealing member 413 for covering the opening 421 of the foam member 212 and thus the opening 21 formed on the second surface of the second container 2. The sealing member 413 may have an optional grip portion 414 for a user to pull the sealing member 413 so as to uncover the opening 421 and opening 21. The grip portion 414 may have a mark thereon to indicate a pulling direction for a user.

When the second container 2 is mounted on the first container 1 at the operative position as shown in FIG. 9 to form the toner supplying container 200, a user can pull the seal members 313, 413 respectively, away from the toner supplying container 200 to allow the first container 1 and the second container 2 communicate to each other through the openings 11, 311, 421 and 21 so that a supply of toner is into the body of the first container 1 from the body of the second container 2.

In operation, when the toner accommodated in the volume of the second container 2 is substantially supplied to the body of the first container 1, a user can disengage the second container 2 from the first container 1, and mount a new or third container (not shown) that is substantially identical to the second container 2 but has toner therein on the first container 1 at the operative position so as to form a new toner supplying container (100 or 200). A supply of the toner from the new or third container is provided into the body of the first container 1. The empty container 2 can be recycled for further use. This way, various devices and/or parts in the container 1 can be used continuously. Nature resources are saved, cost is reduced, and consumers are benefited.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modification, both as to equipment details and operating procedures can be effected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

What is claimed is:

1. A toner supplying container detachably mountable to an image forming apparatus, comprising:

a first container for receiving toner, the first container having a first end, an opposite second end, and a body defined between the first end and the opposite second end, wherein the body has a first surface, a second surface with a plurality of openings formed thereon for receiving a supply of toner into the body and an interior surface:

a second container for accommodating toner and providing toner to the first container, the second container having a first end, an opposite second end, and a body defined between the first end and the opposite second end, wherein the body has an interior surface defining a volume for accommodating toner, a first surface and a second surface with a plurality of openings formed thereon communicating with the volume and corresponding to the plurality of openings formed on the second surface of the first container for permitting a supply of the toner into the body of the first container; and a releasable locking mechanism for releasably locking the first container with the second container at a predetermined position, the releasable locking mechanism having:

a. a supporting member projecting away from the second surface of the first container at the first end of the first container, the supporting member having a first side surface, a second side surface, an inner surface and an outer surface, wherein the first side surface has an opening partially defined by a first surface portion, a second surface portion and an edge portion connecting the first surface portion and the second surface portion;

b. a locking projection provided at the first surface of the second container for engaging with the supporting member of the first container, the locking projection having an engagement portion adapted to be received in the opening of the first side surface of the supporting member and engage with the edge portion of the supporting member when the second container is shifted to be mounted on the first container at the predetermined position;

c. at least one guiding member provided on the second surface of the first container, the guiding member having a groove and a length; and d. at least one projection provided on the second surface of the second container complimentary to the guiding member on the second surface of the first container, wherein when the second container is shifted to be mounted on the first container at the predetermined position, the projection is received in the groove of the guiding member so as to be engaged by the guiding member, wherein when the second container is shifted away from the predetermined position, the engagement portion of the locking projection disengages the edge portion of the supporting member and the projection disengages the guiding member so as to allow the second container to be released from the first container.

2. The toner supplying container according to claim 1, wherein the releasable locking mechanism further comprises additional guiding members provided on the second surface of the first container, each guiding member having a groove and a length, and additional projections provided on the second surface of the second container complimentary to the additional guiding members on the second surface of the first container, wherein when the second container is shifted to be mounted on the first container at the predetermined position, each additional projection is received in the groove of a corresponding additional guiding member so as to be engaged by the additional guiding member, and wherein each pair of neighboring projections defines a recess therebetween to allow each projection to be slidably received into the groove of a corresponding guiding member.

3. The toner supplying container according to claim 2, wherein the releasable locking mechanism further comprises:

a. a matching guiding member provided on the second surface of the first container for preventing misengagement of the first container and the second container, the matching guiding member having a groove and a length that is different from the length of each guiding member; and b. a matching recess provided on the second surface of the second container complimentarily to the matching guiding member on the second surface of the first container, wherein the matching recess is characterized by a width that is substantially same to the length of the matching guiding member to allow the matching guiding member to be received in the matching recess before a projection is received in the groove of the matching guiding member, when the second container is shifted to be mounted on the first container at the predetermined position, so as to be engaged by the matching guiding member.

4. The toner supplying container according to claim 1, wherein the first container further comprises a foam member provided on the second surface for preventing toner from spilling, the foam member having a plurality of openings corresponding to the plurality of openings formed on the second surface of the first container to allow the supply of toner to be received into the body of the first container.

5. The toner supplying container according to claim 1, wherein the first container further comprises a sealing member for covering the plurality of openings formed on the second surface of the first container.

6. The toner supplying container according to claim 1, wherein the second container further comprises a foam member provided on the second surface for preventing toner from spilling, the foam member having a plurality of openings corresponding to the plurality of openings formed on the second surface of the second container to allow the supply of toner into the body of the first container.

7. The toner supplying container according to claim 1, wherein the second container further comprises a sealing member for covering the plurality of openings formed on the second surface of the second container.

8. The toner supplying container according to claim 1, wherein the first container further comprises:

a. a slidable cover having a first end, a second end, a plurality of openings formed therebetween the first end and the second end adapted for communicating with the plurality of the openings formed on the second surface of the first container, and a handle formed proximate to the first end, b. a sliding opening formed on the second surface of the first container proximate to the supporting member and adapted for receiving the handle of the slidable cover;

c. a first sliding projection formed on the interior surface at a first side of the plurality of openings, the first sliding projection defining a sliding groove therein; and d. a second sliding projection formed on the interior surface at a second, opposite side of the plurality of openings, the second sliding projection defining a sliding groove therein, wherein the first sliding projection and the second sliding projection are formed such that the sliding groove of the first sliding projection and the sliding groove of the second sliding projection are adapted to receive the slidable cover therein, wherein the handle is positioned within the sliding opening, extending away from the second surface of the first container, and movable between a first predetermined position and a second predetermined position, and wherein when the handle is positioned at the first predetermined position, the slidable cover closes the plurality of openings formed on the second surface of the first container, and when the handle is moved from the first predetermined position to the second predetermined position, the movement of the handle causes the slidable cover to shift in a direction to open the plurality of openings formed on the second surface of the first container.

9. The toner supplying container according to claim 8, wherein the first container further comprises a foam member provided between the interior surface of and the slidable cover for preventing toner from spilling, the foam member having a plurality of openings corresponding to the plurality of openings formed on the second surface of the second container to allow the supply of toner into the body of the first container.

10. The toner supplying container according to claim 8, wherein the second container further comprises:

a. an end opening formed on the second surface of the second container, wherein the end opening is proximate to the first end of the second container and adapted to be engagable with the handle;

b. a first guiding projection formed on the second surface at a first side of the plurality of openings, the first guiding projection defining a guiding groove therein;

c. a second guiding projection formed on the second surface at a second, opposite side of the plurality of openings, the second guiding projection defining a guiding groove therein; and d. a slidable cover having a first end, a second end, an exterior surface, an opposite interior surface, a plurality of openings formed therebetween the first end and the second end corresponding to the plurality of the openings formed on the second surface of the second container, wherein the first guiding projection and the second guiding projection are formed such that the guiding groove of the first guiding projection and the guiding groove of the second guiding projection are adapted to receive the slidable cover therein with the interior surface of the slidable cover facing the second surface of the second container to allow the slidable cover to be shifted to open or close the plurality of openings formed on the second surface of the second container.

11. The toner supplying container according to claim 10, wherein when the second container is to be mounted on the first container at the predetermined position, the handle is positioned in the first predetermined position and received in the end opening so as to engage with the second surface of the second container, wherein when the second container is shifted to be mounted on the first container at the predetermined position, the shifting movement of the second container causes the handle to move by the engagement between the handle and the end opening from the first predetermined position to the second predetermined position, and the movement of the handle causes the slidable cover to shift in a direction to be able to open the plurality of openings formed on the second surface of the first container.

12. The toner supplying container according to claim 10, wherein the second container further comprises a foam member provided between the second surface of the second container and the interior surface of the slidable cover for preventing toner from spilling.

13. The toner supplying container according to claim 12, wherein the foam member is formed on the interior surface of the slidable cover and has a plurality of openings corresponding to the plurality of openings formed on the slidable cover.

14. The toner supplying container according to claim 13, wherein the second container further comprises a sealing member provided between the second surface of the second container and the interior surface of the slidable cover for covering the plurality of openings formed on the second surface of the second container, the sealing member having a grip portion and being engaged with the foam member formed on the interior surface of the slidable cover.

15. The toner supplying container according to claim 14, wherein when the grip portion is pulled in a direction away from the opening, the motion of the grip portion causes the sealing member to shift in a direction substantially parallel to the motion direction of the grip portion thereby to open at least some of the plurality of openings formed on the second surface of the second container, and the shifting motion of the sealing member causes the slidable cover to move with the sealing member to open at least some of the plurality of openings formed on the second surface of the second container by allowing at least one of the plurality of openings formed on the slidable cover to communicate with at least one of the plurality of openings formed on the second surface of the second container.

16. The toner supplying container according to claim 13, wherein the second container further comprises a plurality of regulating projections formed on the exterior surface of the slidable cover, each regulating projection being formed around the periphery of a corresponding one of the plurality of openings formed on the slidable cover and projecting away from the exterior surface of the slidable cover.

17. A toner supplying container detachably mountable to an image forming apparatus, comprising:

a first container for receiving toner, the first container having:

a. a first end, an opposite second end, and a body defined between the first end and the opposite second end, wherein the body has an interior surface defining a volume, a first surface, and a second surface with a plurality of openings formed thereon communicating with the volume for receiving a supply of toner into the volume;

b. a supporting member projecting away from the second surface of the first container at the first end of the container, the supporting member having a first side surface, a second side surface, an inner surface and an outer surface, wherein the first side surface has an opening partially defined by a first surface portion, a second surface portion and an edge portion connecting the first surface portion and the second surface portion;

c. at least one guiding member provided on the second surface of the first container, the guiding member having a groove and a length; and a second container for accommodating toner and mountable to the first container at a predetermined position for providing toner to the first container, the second container having:

a. a first end, an opposite second end, and a body defined between the first end and the opposite second end, wherein the body has an interior surface defining a volume for accommodating toner, a first surface and a second surface with a plurality of openings formed thereon communicating with the volume and corresponding to the plurality of openings formed on the second surface of the first container for permitting a supply of the toner into the body of the first container;

b. a locking projection provided at the first surface of the second container for engaging with the supporting member of the first container, the locking projection having an engagement portion adapted to be received in the opening of the first side surface of the supporting member of the first container and engage with the edge portion of the supporting member of the first container when the second container is shifted to be mounted on the first container at the predetermined position; and c. at least one projection provided on the second surface of the second container complimentary to the guiding member on the second surface of the first container, wherein when the second container is shifted to be mounted on the first container at the predetermined position, the projection is received in the groove of the guiding member so as to be engaged by the guiding member, wherein when the second container is shifted away from the predetermined position, the engagement portion of the locking projection disengages the edge portion of the supporting member and the projection disengages the guiding member so as to allow the second container to be released from the first container.

18. The toner supplying container according to claim 17, wherein the first container further comprises:

a. a slidable cover having a first end, a second end, a plurality of openings formed therebetween the first end and the second end adapted for communicating with the plurality of the openings formed on the second surface of the first container, and a handle formed proximate to the first end, b. a sliding opening formed on the second surface of the first container proximate to the supporting member and adapted for receiving the handle of the slidable coven c. a first sliding projection formed on the interior surface at a first side of the plurality of openings, the first sliding projection defining a sliding groove therein, and d. a second sliding projection formed on the interior surface at a second, opposite side of the plurality of openings, the second sliding projection defining a sliding groove therein, wherein the first sliding projection and the second sliding projection are formed such that the sliding groove of the first sliding projection and the sliding groove of the second sliding projection are adapted to receive the slidable cover therein, wherein the handle is positioned within the sliding opening, extending away from the second surface of the first container, and movable between a first predetermined position and a second predetermined position, and wherein when the handle is positioned at the first predetermined position, the slidable cover closes the plurality of openings formed on the second surface of the first container, and when the handle is moved from the first predetermined position to the second predetermined position, the movement of the handle causes the slidable cover to shift in a direction to open the plurality of openings formed on the second surface of the first container.

19. The toner supplying container according to claim 18, wherein the first container further comprises a foam member provided between the interior surface of and the slidable cover for preventing toner from spilling, the foam member having a plurality of openings corresponding to the plurality of openings formed on the second surface of the second container to allow the supply of toner into the body of the first container.

20. The toner supplying container according to claim 18, wherein the second container further comprises:

a. an end opening formed on the second surface of the second container, wherein the end opening is proximate to the first end of the second container and adapted to be engagable with the handle;

b. a first guiding projection formed on the second surface at a first side of the plurality of openings, the first guiding projection defining a guiding groove therein;

c. a second guiding projection formed on the second surface at a second, opposite side of the plurality of openings, the second guiding projection defining a guiding groove therein; and d. a slidable cover having a first end, a second end, an exterior surface, an opposite interior surface, a plurality of openings formed therebetween the first end and the second end corresponding to the plurality of the openings formed on the second surface of the second container, wherein the first guiding projection and the second guiding projection are formed such that the guiding groove of the first guiding projection and the guiding groove of the second guiding projection are adapted to receive the slidable cover therein with the interior surface of the slidable cover facing the second surface of the second container to allow the slidable cover to be shifted to open or close the plurality of openings formed on the second surface of the second container.

21. The toner supplying container according to claim 20, wherein when the second container is to be mounted on the first container at the predetermined position, the handle is positioned in the first predetermined position and received in the end opening so as to engage with the second surface of the second container, wherein when the second container is shifted to be mounted on the first container at the predetermined position, the shifting movement of the second container causes the handle to move by the engagement between the handle and the end opening from the first predetermined position to the second predetermined position, and the movement of the handle causes the slidable cover to shift in a direction to be able to open the plurality of openings formed on the second surface of the first container.

22. The toner supplying container according to claim 20, wherein the second container further comprises a foam member provided between the second surface of the second container and the interior surface of the slidable cover for preventing toner from spilling.

23. The toner supplying container according to claim 22, wherein the foam member is formed on the interior surface of the slidable cover and has a plurality of openings corresponding to the plurality of openings formed on the slidable cover.

24. The toner supplying container according to claim 23, wherein the second container further comprises a sealing member provided between the second surface of the second container and the interior surface of the slidable cover for covering the plurality of openings formed on the second surface of the second container, the sealing member having a force applying portion and being engaged with the foam member formed on the interior surface of the slidable cover.

25. The toner supplying container according to claim 24, wherein when the force applying portion is pulled in a direction away from the opening, the motion of the force applying portion causes the sealing member to shift in a direction substantially parallel to the motion direction of the force applying portion thereby to open at least some of the plurality of openings formed on the second surface of the second container, and the shifting motion of the sealing member causes the slidable cover to move with the sealing member to open at least some of the plurality of openings formed on the second surface of the second container by allowing at least one of the plurality of opening formed on the slidable cover to communicate with at least one of the plurality of openings formed on the second surface of the second container.

26. The toner supplying container according to claim 25, wherein the force applying portion comprises a grip portion.

27. The toner supplying container according to claim 24, wherein the sealing member comprises a film.

28. The toner supplying container according to claim 23, wherein the second container further comprises a plurality of regulating projections formed on the exterior surface of the slidable cover, each regulating projection being formed around the periphery of a corresponding one of the plurality of openings formed on the slidable cover and projecting away from the exterior surface of the slidable cover.

29. A toner supplying container detachably mountable to an image forming apparatus, comprising:

a first container for receiving toner, the first container having:

a. a first end, an opposite second end, and a body defined between the first end and the opposite second end, wherein the body has an interior surface defining a volume, a first surface, and a second surface with a plurality of openings formed thereon communicating with the volume for receiving a supply of toner into the volume;

b. a supporting member projecting away from the second surface of the first container at the first end of the container, the supporting member having a first side surface, a second side surface, an inner surface and an outer surface, wherein the first side surface has an opening partially defined by a first surface portion, a second surface portion and an edge portion connecting the first surface portion and the second surface portion;

c. a plurality of guiding members provided on the second surface of the first container, each guiding member having a groove and a length; and a second container for accommodating toner and mountable to the first container at a predetermined position for providing toner to the first container, the second container having:

a. a first end, an opposite second end, and a body defined between the first end and the opposite second end, wherein the body has an interior surface defining a volume for accommodating toner, a first surface and a second surface with a plurality of openings formed thereon communicating with the volume and corresponding to the plurality of openings formed on the second surface of the first container for permitting a supply of the toner into the body of the first container;

b. a locking projection provided at the first surface of the second container, the locking projection having an engagement portion adapted to be received in the opening of the first side surface of the supporting member of the first container and to engage with the edge portion of the supporting member of the first container when the second container is shifted to be mounted on the first container at the predetermined position; and c. a plurality of projections provided on the second surface of the second container complimentary to the plurality of guiding members on the second surface of the first container.

30. The toner supplying container according to claim 29, further comprising:

a. a matching guiding member provided on the second surface of the first container for preventing misengagement of the first container and the second container, the matching guiding member having a groove and a length that is different from the length of each guiding member; and b. a matching recess provided on the second surface of the second container complimentarily to the matching guiding member on the second surface of the first container, wherein the matching recess is characterized by a width that is substantially same to the length of the matching guiding member to allow the matching guiding member to be received in the matching recess before a projection is received in the groove of the matching guiding member, when the second container is shifted to be mounted on the first container at the predetermined position, so as to be engaged by the matching guiding member.

31. A toner supplying container detachably mountable to an image forming apparatus, comprising:

a first container for receiving toner, the first container having a first end, an opposite second end, and a body defined between the first end and the opposite second end, wherein the body has a first surface, a second surface with an opening formed thereon for receiving a supply of toner into the body;

a second container for accommodating toner and providing toner to the first container, the second container having a first end, an opposite second end, and a body defined between the first end and the opposite second end, wherein the body has an interior surface defining a volume for accommodating toner, a first surface and a second surface with an opening formed thereon communicating with the volume and adapted for communicating with the opening formed on the second surface of the first container for permitting a supply of the toner into the body of the first container; and a releasable locking mechanism for releasably locking the first container with the second container at a predetermined position, the releasable locking mechanism having:

a. a supporting member projecting away from the second surface of the first container at the first end of the first container, the supporting member having a first side surface, a second side surface, an inner surface and an outer surface, wherein the first side surface has an opening partially defined by a first surface portion, a second surface portion and an edge portion connecting the first surface portion and the second surface portion;

b. a locking projection provided at the first surface of the second container for engaging with the supporting member of the first container, the locking projection having an engagement portion adapted to be received in the opening of the first side surface of the supporting member and engage with the edge portion of the supporting member when the second container is shifted to be mounted on the first container at the predetermined position;

c. at least one guiding member provided on the second surface of the first container, the guiding member having a groove and a length; and d. at least one projection provided on the second surface of the second container complimentary to the guiding member on the second surface of the first container, wherein when the second container is shifted to be mounted on the first container at the predetermined position, the projection is received in the groove of the guiding member so as to be engaged by the guiding member, wherein when the second container is shifted away from the predetermined position, the engagement portion of the locking projection disengages the edge portion of the supporting member and the projection disengages the guiding member so as to allow the second container to be released from the first container.

32. The toner supplying container according to claim 31, wherein the releasable locking mechanism further comprises additional guiding members provided on the second surface of the first container, each guiding member having a groove and a length, and additional projections provided on the second surface of the second container complimentary to the additional guiding members on the second surface of the first container, wherein when the second container is shifted to be mounted on the first container at the predetermined position, each additional projection is received in the groove of a corresponding additional guiding member so as to be engaged by the additional guiding member, and wherein each pair of neighboring projections defines a recess therebetween to allow each projection is slidably received into the groove of a corresponding guiding member.

33. The toner supplying container according to claim 32, wherein the releasable locking mechanism further comprises:

a. a matching guiding member provided on the second surface of the first container for preventing misengagement of the first container and the second container, the matching guiding member having a groove and a length that is different from the length of each guiding member; and b. a matching recess provided on the second surface of the second container complimentarily to the matching guiding member on the second surface of the first container, wherein the matching recess is characterized by a width that is substantially same to the length of the matching guiding member to allow the matching guid ing member to be received in the matching recess before a projection is received in the groove of the matching guiding member, when the second container is shifted to be mounted on the first container at the predetermined position, so as to be engaged by the matching guiding member.

34. The toner supplying container according to claim 31, wherein the first container further comprises a foam member provided on the second surface for preventing toner from spilling, the foam member having an opening corresponding to the opening formed on the second surface of the first container to allow the supply of toner to be received into the body of the first container.

35. The toner supplying container according to claim 34, wherein the first container further comprises a sealing member for covering the opening formed on the second surface of the first container.

36. The toner supplying container according to claim 35, wherein the second container further comprises a foam member provided on the second surface for preventing toner from spilling, the foam member having an opening corresponding to the opening formed on the second surface of the second container to allow the supply of toner into the body of the first container.

37. The toner supplying container according to claim 36, wherein the second container further comprises a sealing member for covering the opening formed on the second surface of the second container.

* * * * *